United States Patent [19]

Greenwood

[11] Patent Number: 4,717,357

[45] Date of Patent: Jan. 5, 1988

[54] SYSTEM AND METHOD FOR ELECTRICAL POWER INSTALLATION

[75] Inventor: William S. Greenwood, Nutley, N.J.

[73] Assignee: Thomas & Betts Corporation, Raritan, N.J.

[21] Appl. No.: 876,509

[22] Filed: Jun. 20, 1986

Related U.S. Application Data

[63] Continuation of Ser. No. 630,795, Jul. 13, 1984, abandoned.

[51] Int. Cl.[4] ..... H01R 9/07

[52] U.S. Cl. ..... 439/492; 307/147; 439/925

[58] Field of Search ..... 339/21 R, 22 R, 22 B, 339/28, 29 R, 32 M, 95–99, 176 MF; 307/147, 149, 42; 29/857, 868, 872, 873

[56] References Cited

U.S. PATENT DOCUMENTS

| | | | |
|---|---|---|---|
| 2,964,587 | 12/1960 | Minot | 174/117 |
| 3,143,214 | 8/1964 | Moore et al. | 211/26 |
| 3,281,762 | 10/1966 | Jones | 339/198 |
| 3,355,699 | 11/1967 | Oshva | 339/99 |
| 3,496,518 | 2/1970 | Neumann et al. | 339/21 |
| 3,500,056 | 3/1970 | Riley | 339/32 M |
| 3,715,627 | 2/1973 | D'Ausilio | 307/147 |
| 3,720,778 | 3/1973 | Woertz et al. | 339/99 R |
| 3,816,818 | 6/1974 | Meier | 339/99 |
| 3,818,415 | 6/1974 | Evans et al. | 339/17 |
| 3,832,503 | 8/1974 | Crane | 200/51 |
| 3,864,011 | 2/1975 | Huber | 339/103 |
| 3,891,293 | 6/1975 | Jones | 339/97 C |
| 3,907,396 | 9/1975 | Huber | 339/103 |
| 4,065,199 | 12/1977 | Andre et al. | 339/97 C |
| 4,108,523 | 8/1978 | Bolis | 339/22 B |
| 4,181,388 | 1/1980 | Donato | 339/21 |
| 4,181,395 | 1/1980 | Grabowski | 339/176 MF |
| 4,219,928 | 9/1980 | Kuo | 174/117 FF |
| 4,240,687 | 12/1980 | Bunnell et al. | 339/99 |
| 4,240,688 | 12/1980 | Sotolongo | 339/122 |
| 4,289,370 | 9/1981 | Storck | 339/125 |
| 4,315,662 | 2/1982 | Greenwood | 339/97 C |
| 4,351,579 | 9/1982 | Kordes et al. | 339/14 |
| 4,463,998 | 8/1984 | Reavis et al. | 339/97 P |
| 4,477,131 | 10/1984 | Joly | 339/98 |
| 4,480,889 | 11/1984 | Greenwood | 339/99 R |
| 4,589,715 | 5/1986 | Weisenburger | 339/17 F |
| 4,602,840 | 7/1986 | Romatzick | 339/97 |
| 4,636,017 | 1/1987 | Boteler | 339/17 |

FOREIGN PATENT DOCUMENTS

| | | |
|---|---|---|
| 459876 | 2/1974 | Australia . |
| 2031215 | 3/1974 | Fed. Rep. of Germany . |
| 2254395 | 5/1974 | Fed. Rep. of Germany . |

OTHER PUBLICATIONS

Amp Instruction Sheet, IS 3131, Undercarpet Power Cabling System, 10–1983.

Hubbell System PDC Application Installation Manual, pp. 1–28.

T+B Cost/Resale Price Schedule, Nov. 15, 1982, 2 pages.

T+B Comm. Wiring Systems Div. Price Schedule, Jun. 24, 1982, p. 12.

Hubbell System PDC, Suggested Trade Prices, May 1, 1984, 4 pages.

*Primary Examiner*—Neil Abrams

*Attorney, Agent, or Firm*—Robert M. Rodrick; Salvatore J. Abbruzzese

[57] ABSTRACT

A flat multiconductor cable power distribution system has a discrete wire multi-phase feeder, a main flat cable having at least four conductors, the cable being connected to the feeder to have plural phase energization. An insulation-piercing adapter overlies and is connected to the main cable and is energized with a selective one of the plural phases. In a particular arrangement, a secondary multiconductor cable is connected to the main cable by the adapter. A power outlet may be electrically connected to the secondary cable at the juncture of the main and secondary cables and the adapter.

13 Claims, 8 Drawing Figures

SYSTEM AND METHOD FOR ELECTRICAL POWER INSTALLATION

This is a continuation of application Ser. No. 06/630,795, filed July 13, 1984 now abandoned.

FIELD OF THE INVENTION

This invention relates generally to distibution of electrical power and pertains more particularly to multiconductor flat cable power distribution and methods for installing systems therewith.

BACKGROUND OF THE INVENTION

From its inception in the course of a program sponsored in the early 1970's by NASA, flat conductor cable power distribution has been extensive evolution. The rudimentary sysrem which emanated from the NASA program made use of cables having three conductors of rectangular cross-section embedded in electrical insulation and effected interconnection of plural such cables by arranging same in mutual abutment in the same plane, i.e., upon a floor. This system employed connectors in the form of straps underlying the cables and having end portions for making insulation-piercing connection with the conductors to be joined. A number of present commercial undercarpet wiring systems follow this approach.

One of the initially introduced commercial undercarpet wiring systems, that of Thomas & Betts Corporation, the assignee of the subject application, involves a method of laying one cable upon another and interconnecting conductors by forming an opening through the conductors, placing a generally L-shaped insulation-piercing connector in the opening and crimping same upon exterior surfaces of the cables to provide interconnection without the connector straddling or otherwise extending over any conductors other than those intended to be interconnected.

In conducting power from a first or main cable run connected to the power feeder of a building to a desired power location, both of the above types of systems extend a second cable, connected as described above to the main cable, to such location and there discretely wire a power outlet pedestal of conventional character to a transition fitting which itself is in insulation-piercing relation with the second cable at such location.

Successively to such initial system versions, the evolution of flat conductor cable power distribution systems embraced an improvement whereby the power outlet pedestal was rendered energized without need for discrete wiring. Pedestals have thus become known which may be applied directly to a single-phase, three-conductor cable, insulation-piercing contacts of such pedestals having internal connectors having insulation-piercing end portions for electrical connection with the cable conductors and other end portions adapted for engagement with the prongs of plugs inserted in pedestal power outlet receptacles. A device of this type is shown in commonly-assigned U.S. Pat. No. 4,479,692, issued on Oct. 30, 1984 and entitled "Receptacle for Flat Multi-Conductor Cable".

In a still further development, such as is shown in commonly-assigned U.S. Pat. No. 4,480,889, issued on Nov. 6, 1984 and entitled "Apparatus and Method for Tapping or Splicing Flat Multi-Conductor Cable", the capability of the above discrete-wire-free pedestal was expanded to also provide for the splicing of another cable to the cable energizing the receptacle. Ninety-degree folding of such additional cable effectively provides a tap connection spatially coincident with the pedestal termination.

Despite the progress of such evolution in flat conductor cable power distribution systems, the installation planner still presently has limited horizon to the extent that one can only realize the advantage of the last two-mentioned improvements after having tapped such pedestal-energizing cable to the main cable run, or having run all three conductor cable branches from the wall. Thus, the only known connections to be made directly to a five conductor flat cable do not encompass the use of insulation-piercing pedestals, be they of splice or non-splice variety, but involve tapping or splicing a second cable thereto. Based on requirements to balance loads among the three phases typically at hand, a minimum of three such non-outlet associated connections need be made in the system installation.

As an additional consideration, the known connections directly to five conductor flat cable are not at visibly determinable locations upon completion of system installation and placement of carpeting atop the system. Thus, the abutting and overlapping connections alluded to at the outset above are not power outlet locations, but are secreted beneath the carpeting in locations only determinable by reference to the installation wiring drawings or, in their absence or departure therefrom, only by removing carpet squares and inspecting the system. In this connection, there remains a vestige of practical difference between undercarpet power distribution systems and the traditional conduit systems, the latter involving cable connections only at power outlet locations, such as junction boxes and pedestals.

SUMMARY OF THE INVENTION

The present invention has as its primary object the provision of improved planning and installing of flat conductor cable power distribution systems.

Another general object of the invention is to provide undercarpet power distribution installations with the practically desirable characteristic of traditional conduit systems above noted.

A more particular object of the invention is to expand interconnections to five conductor flat cable and thus effect a reduction in required numbers of non-pedestal connections in the installation of such systems.

In attaining the foregoing and other objects, the invention provides a method of successively effecting pedestal connections, directly upon a flat cable main run with multiple five conductors, at respective different phases of such main run. By this practice, one can achieve full system installation without resort to non-pedestal connections. Further, in the latter exclusion of non-pedestal connections, one eliminates need for resort to installation wiring diagrams or carpet tile removal for an appreciation of the installed system, all connections being at power outlet locations, as in the traditional conduit systems.

In preferred practice and system in accordance with the invention, all needed service outlet locations can be served by secondary cables of three or four conductors having connection to the main cable run at power outlet locations thereon.

The foregoing and other objects and features of the invention will be further understood from the following detailed description of practices thereof and apparatus therefor and from the drawings wherein like reference numerals identify like parts throughout.

DESCRIPTION OF PREFERRED EMBODIMENTS AND PRACTICES

Figure 8:
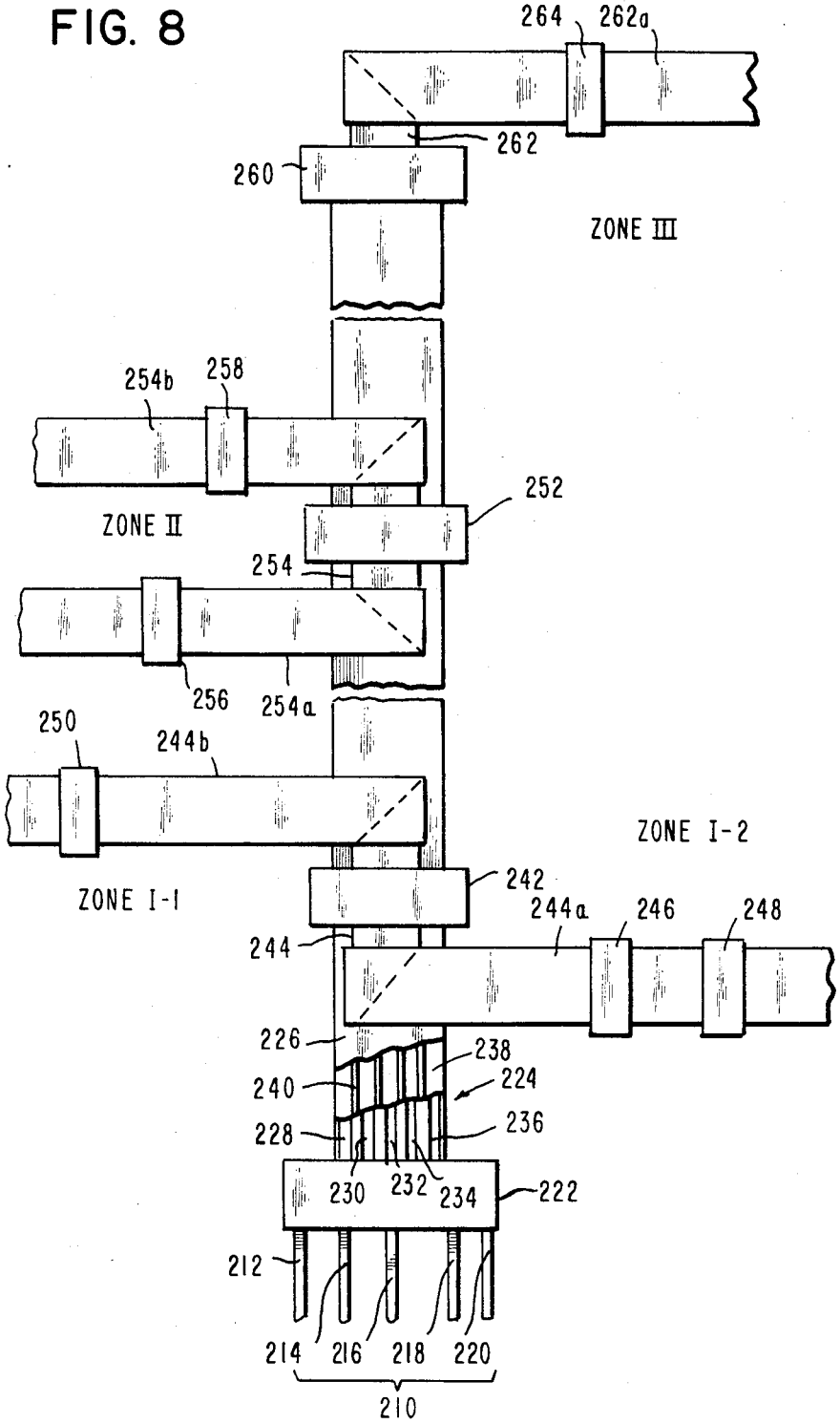
FIG. 8 depicts a system in accordance with the invention.

Referring initially to FIG. 8, an installation area is shown wherein a system planner has elected to distribute power on a per phase basis respectively into different zones I-1, I-2, II and III, for phase-balancing or other purposes.

In implementing such planned system in accordance with the invention, one connects power mains or discrete feeder conductors 210, comprising phase conductors 212, 214 and 216, ground conductors 218 and neutral conductor 220 at transition box 222, to flat conductor cable 224. Cable 224 has an electrically conductive shield 226 and individual rectangular cross-section phase conductors 228, 230 and 232, ground conductor 234 and neutral conductor 236, all encased in electrically insulative casing 238. Perforated margins 240 intervene encased conductors to facilitate tearing or otherwise separating individual insulated conductors from the cable.

Cable 224 extends in a main run from box 222 to first phase pedestal power outlet 242, the structure of which will be discussed in detail below, whereat secondary cable 244 has its three conductors respectively electrically connected to phase conductor 228, ground conductor 234 and neutral conductor 236 of cable 224. Secondary cable 244 extends through outlet connection 242 and is folded upon itself aside same to define secondary cable runs 244*a* and 244*b*, which have indicated opposite sense run directions, as shown, perpendicular to cable 224. Pedestal power outlets 246 and 248 are applied to cable run 244*a* and pedestal power outlet 250 to cable run 244*b*, other outlets being added as desired on runs 244*a* and 244*b*, which may be further folded to effect directional changes. Outlets 246, 248 and 250 may be of type shown in the above-referenced '661 application.

Main cable 224 continues beyond pedestal connection 242 and cable run 244*b* into second phase pedestal power outlet 252 at which another secondary cable 254 has its three conductors respectively, electrically connected to phase conductor 230, ground conductor 234 and neutral conductor 236 of cable 224.

Secondary cable 254 extends through connection outlet 252 and is folded upon itself aside same to define cable runs 254*a* and 254*b*, which have indicated like sense run directions, as shown, perpendicular to cable 224. Pedestal power outlets 256 and 258, of like type to units 246, 248 and 250, are applied respectively to cable runs 254*a* and 254*b*.

Main cable 224 further continues beyond pedestal connection 252 and cable run 254*b* into third phase pedestal power outlet 260, which may be the final termination for cable 224. Here, further secondary cable 262 has its three conductors respectively connected to phase conductor 232 of cable 224 and has its ground and neutral conductors connected to those of cable 224.

Cable 262 extends to one side of outlet connection 260 and is folded at such side to define secondary cable run 262*a*, to which pedestal power outlet 264, again of type shown in the application noted above, is connected.

Figure 1:
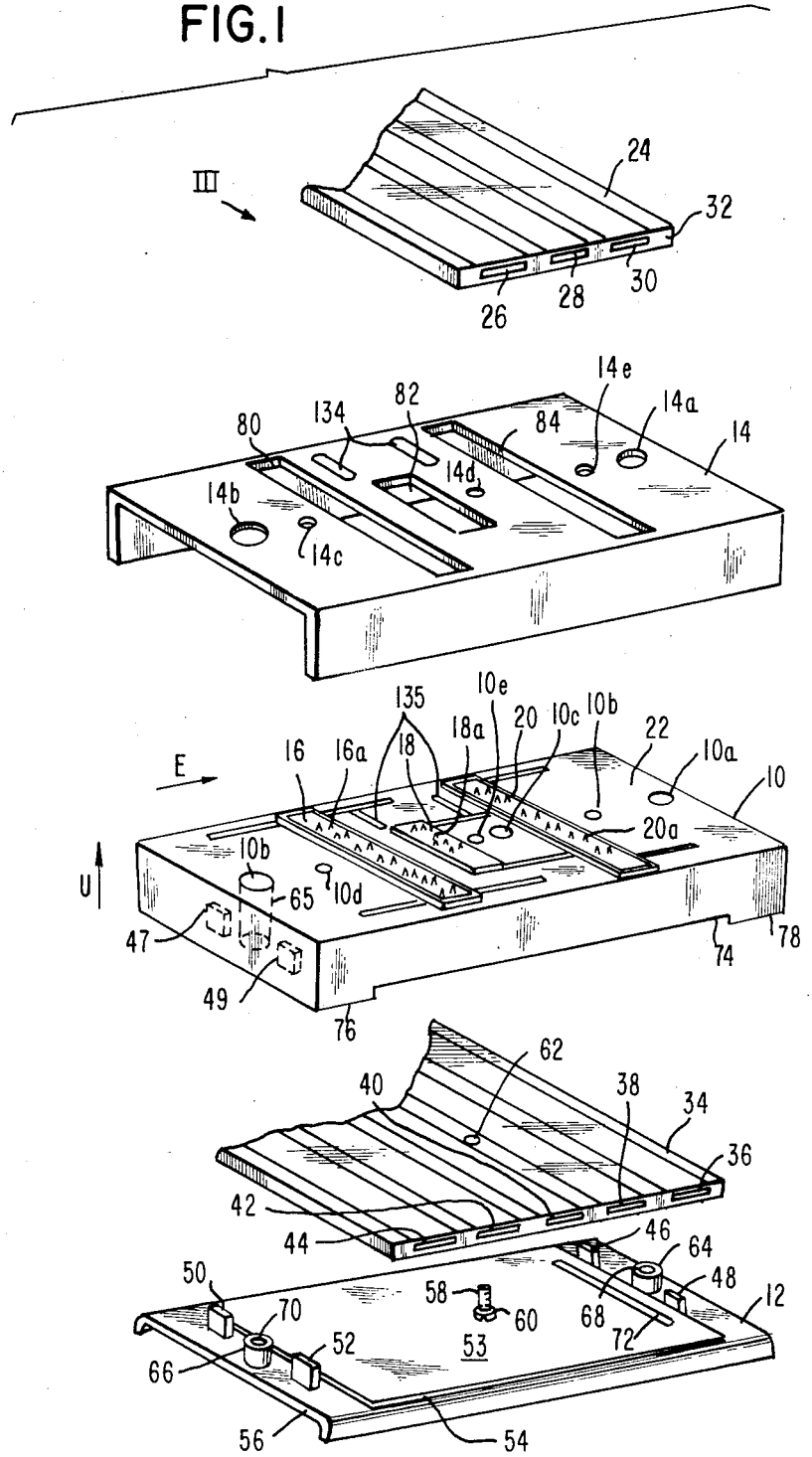
FIG. 1 is an exploded perspective view of a connecting device in accordance with the invention, shown also with multiconductor cables having respective different numbers of conductors.

At any or all of pedestals 246, 258, etc. of FIG. 8, further three conductor branches may be added to the phase of such pedestals by use, at the pedestal, of the three conductor tap adapter of the above-noted '662 application. Referring to FIG. 1, a connecting device for use as units 242, 252 and 260 and thus enabling the system and practice of FIG. 8 is shown, including contact support member 10, base 12 and cover 14. Support member 10 is formed of a suitable insulative material and is generally of rectangular configuration, being elongate in direction E and upstanding in direction U. A first contact element set comprising contact elements 16, 18 and 20 is disposed in fixed positional manner on first surface 22 of support member 10, for confronting a three conductor cable 24. Cable 24 includes flat conductors 26, 28 and 30 disposed in insulative casing 32. For reference purposes, and by way of accepted industry convention, conductor 30 is an electrical neutral conductor and casing 32 includes a white coloration to identify this conductor. Conductor 28 is the ground conductor and casing 32 includes a green coloration overlying same. Conductor 26 is a live (single-phase) conductor and may bear overlying casing indication in the colors black, red or blue. Contact elements 16, 18 and 20 are of insulation-piercing type including conventional insulation-piercing elements 16*a*, 18*a* and 20*a* and will respectively engage electrically conductors 26, 28 and 30 upon assembly.

A second contact element set is included in support member 10, to be discussed more particularly below in connection with FIG. 2, and is disposed at the underside of support member 10 for insulation-piercing engagement with conductors of a cable 34. Cable 34 is shown to be of five conductor (three-phase) type having neutral conductor 36, ground conductor 38 and individual phase conductors 40, 42 and 44 (A, B and C phases). The conductors of cable 34 are also typically color-coded.

Base 12 includes cable guides 46–52 aside cable receipt expanse 53 which is defined by an insulative layer 54 disposed atop metal substrate 56. Securing means 58 is preferably integral with substrate 56 and is in the form of a threaded member having an annular insulator 60 adjacent insulative layer 54. The positioning of threaded means 58 in relation to guides 46–52 is such that, upon placement of cable 34 upon base 12, means 58 passes through cable 34 at location 62, i.e., through the insulation between conductors 38 and 40, at which time annular insulator 60 is resident in cable 34, precluding electrical continuity, through means 58, between conductors 38 and 40. It should be noted that with four-conductor cable, for example, such poitioning of threaded means 58 through the cable can be assured by using the neutral conductor 36 as a reference and placing the adjacent edge of the cable into engagement with base guides 46–48. Upstanding posts or projections 64 and 66 will, upon assembly of member 10 with base 12, nest in underside recesses in member 10 one such recess being shown at 65. Guides 46–52 in combination with support member tabs 47 and 49 will provide an anti-bowing or anti-deflection capability for base 12 and cable 34 seated thereon. Posts 64 and 66 include threaded central openings 68 and 70, respectively, for assembly purposes. A white indicium 72 is applied to insulative layer 54 to indicate to the user the proper polarization of cable 34 with respect to base 12, namely, that white (neutral) conductor 36 should overly indicium 72.

As will be seen, support member 10 includes a central lower indentation 74 through which cable 34 will extend upon assembly. Legs 76 and 78 of member 10 will abut the upper surface of base 12 on assembly. Cover 14 is dimensioned to fit telescopically over support member 10 on assembly and includes upper surface openings 80, 82 and 84, through which contacts 16, 18 and 20 respectively extend to engage cable 24 when the latter is applied to the upper surface of cover 14. In assembly, openings **14*a* and 10*a* are aligned, as are openings 14*b* and 10*b* to permit threading of screws into posts 64 and 66. A nut is applied in opening 10*c* to securing means 58**.

Figure 2:
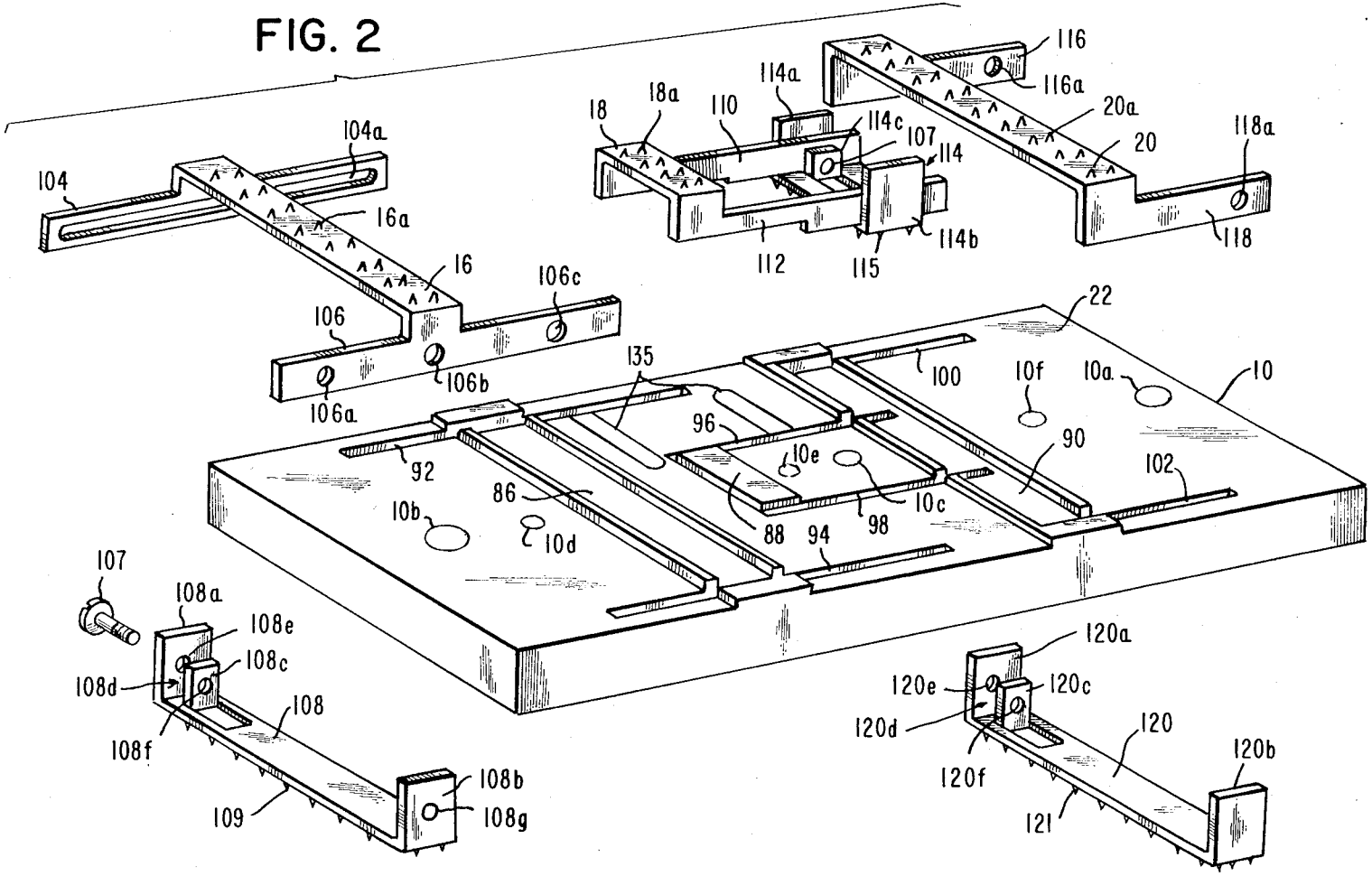
FIG. 2 is an exploded perspective view of the contact support member of FIG. 1 and the contact element sets supported thereby.

Referring to FIG. 2, wherein the contact elements are shown in exploded manner relative to support member 10, it will be seen that upper surface 22 includes contact seats 86, 88 and 90, the perimeters of which extend upwardly from surface 22 in measure equal to the depth of cover 14 adjacent openings 80–84 of FIG. 1. Elongate channels 92 and 94 extend in both directions from contact seat 86. Channels 96 and 98 extend rightwardly of contact seat 88 and into contact seat 90. Channels 100 and 102 extend rightwardly of contact seat 90.

Contact element 16 has flanges 104 and 106 integral therewith and serving as conductive means for electrically connecting contact element 16 with its counterpart contact element 108 of the second set of contacts referred to above. As will be discussed further below, contact element 108 includes conventional insulation-piercing elements 109 projecting from its undersurface and is supported in flanges 104 and 106 for translatory movement in support member 10. Contact element 18 includes flanges 110 and 112, again integral therewith, and serving as conductive means for interconnecting contact element 18 with its counterpart contact element 114 of the second set. Conventional insulation-piercing elements 115 project from the undersurface of contact element 114. Contact element 20 has integral flanges 116 and 118 serving as conductive means for connecting same with its counterpart contact element 120 of the second set. Conventional insulation-piercing elements 121 project from the undersurface of contact element 120.

Contact element 16 includes in flange 104 a track **104*a* to support contact element 108 for translation into any selective one of three positions. For defining such positions, flange 106 includes detents in the form of through openings 106*a*, 106*b*, and 106*c*. Contact 108 includes end flanges 108*a* and 108*b*, which are respectively exteriorly aside flanges 104 and 106 upon assembly of contact elements 16 and 108. Wall 108*c* is struck upwardly from the floor of contact element 108 to provide a channel 108*d*, in which flange 104 resides. A threaded member 107 passes through opening 108*e*, through track 104*a* and is threaded into opening 108*f* to secure the assembly. Boss 108*g* is situated on the interior side of flange 108*b* and is sized to removably reside in any of openings 106*a*, 106*b* or 106*c* to effect the proper positioning of contact element 108**.

An assembly of a first set contact element and a second set contact element is shown in FIG. 2 in the case of contact element 18 and its counterpart second set contact element 114 in FIG. 2 with parts being identified in a manner similar to those designated for contact elements 16 and 108.

In assembling support member 10 and its first and second set contact elements, the first set contact elements are first inserted as follows. Flanges 104 and 106 are disposed in channels 92 and 94, whereby contact element 16 resides on seat 86. Flanges 110 and 112 are disposed in channels 96 and 98, whereby contact element 18 resides on seat 88. Flanges 116 and 118 are disposed in channels 100 and 102, whereby contact element 20 resides on seat 90, being spaced by member 10 above flanges 110 and 112, which are stepped down as indicated. Next, contact elements 114 and 120 are inserted into the underside of member 10 and secured respectively to flanges 110, 112 and 116, 118. Selection is made for the state of contact element 108 and it is inserted into the underside of member 10, translated into selected position and secured in place. The showing of member 10 in FIG. 1 is thus reached.

Figure 3:
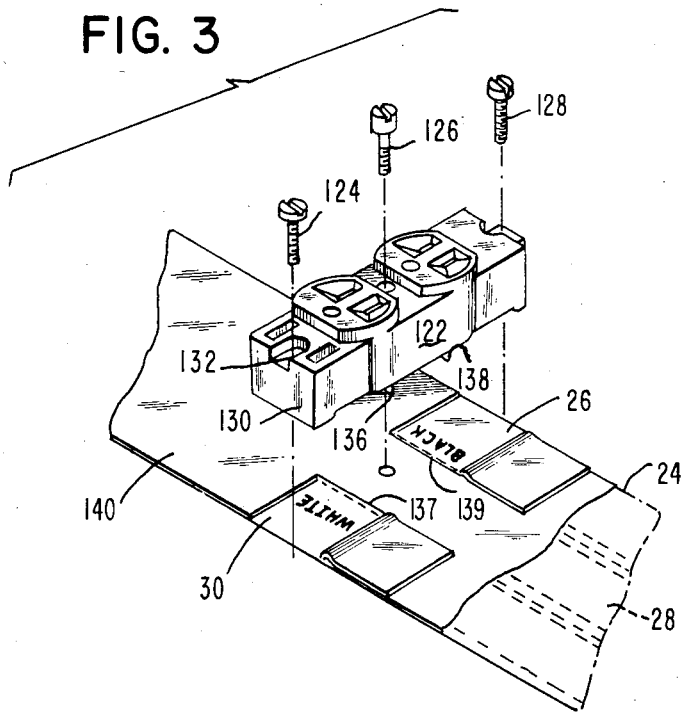
FIG. 3 is a partial perspective and exploded view, as seen in direction III of FIG. 1, of a power outlet for a three-conductor cable, shown here with overlying shield.

Referring to FIG. 3, the assembly of components above discussed is expanded to include receptacle 122 and the respective and fastener screws 124, 128 and a grounding fastener screw 126. The receptacle 122 carries indicia as at 130 which are cooperative with the indicia on the cable indicative of proper receptacle orientation to insure correct polarity of electrical connections to be made. Further in this regard and to insure proper placement orientation of the receptacle on the cable, the receptacle has screw-through passages which function as a telltale cooperative with cover openings **14*c–e* and support member openings 10*d–f* (FIG. 1) when correct receptacle placement is effected to indicate such condition. Another safeguard that insures that proper orientation must be employed to installed the receptacle is provided by tabs 136, 138 at the underside of the receptacle which must pass through cable 24 at perforations 137, 139 between the ground conductor and the live and neutral conductors and be received in openings 134, 135 of cover 14 and support member 10, respectively, in order for the receptacle to seat properly. If reciprocal orientation were attempted, the tabs would not line up with openings 134, 135** and hence not pass therethrough preventing proper seating.

Figure 4:
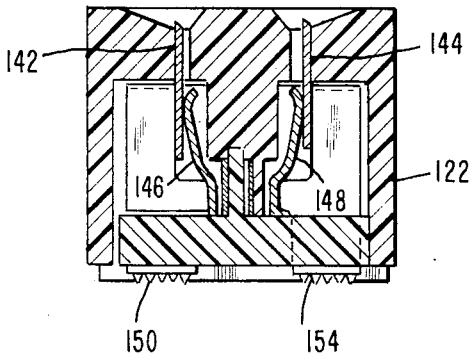
FIG. 4 is a typical sectional view of the FIG. 3 receptacle with appliance plug prongs in place.

The protective metallic or grounding shield 140 on top of cable 24 will, as a preliminary to connecting the receptacle thereto, be removed or cut and laid back in the rectangular pattern as shown in regions overlying the live and neutral conductors 26 and 30 of the cable leaving exposed the insulative covering in which said conductors are encased. The shield may be cut and laid back by folding same rightwardly on top of uncut portions of the shield since this facilitates effecting repair to the shield in the event the receptacle is removed. Like cable preparation is made for cable 34 of FIG. 1. It should be appreciated, however, that the cable may be prepared by full displacement of the cable shield so as to expose the entire upper surface thereof for insulation-piercing connection to the receptacle. More specific understanding of the receptacle will be had by consideration of the U.S. Pat. No. 4,479,692 identified hereinabove and hereby incorporated by reference. In particular, FIGS. 2–5 of such patent show the contact elements thereof as having first end portions for engaging the appliance prong terminals and second end portions for insulation piercing the cable. For immediate reference purposes, FIG. 4 hereof shows a typical section of the pedestal with appliance prongs shown at 142, 144, with contact element first portions at 146, 148 and with second end portions 150, 154.

Figure 5:
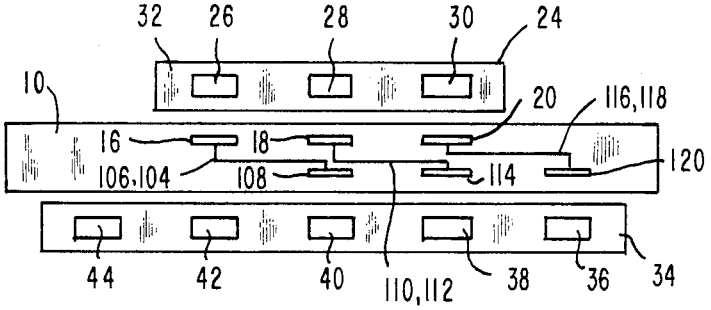
FIGS. 5, 6 and 7 are schematic views showing respective different phase connections made between the cables of FIG. 1 through use of the FIG. 1 device in its several states.

Referring to FIG. 5, contact support member 10 is shown schematically in first operative state between cables 24 and 34, as it would be upon securement of the FIG. 3 pedestal to the FIG. 1 connection device with the cables in indicated position. As will be seen, cable 24 is laterally centered with respect to support member 10, as is also the case for cable 34. Although neutral conductor 30 laterally overlies ground conductor 38, the support member effects a lateral connection transition of one conductor step, whereby conductor 30 is connectable to its counterpart neutral conductor 36, flanges 116 and 118 effecting such transition between first set contact element 20 and second set contact element 120.

A like one step transition is also fixedly provided as between ground conductors 28 and 38 through flanges 110 and 112 interconnecting first set contact element 18 and second set counterpart element 114.

In the FIG. 5 setting of support member 10, a further one step transition rightwardly is also provided as between phase conductors 26 and 40 through flanges 104 and 106.

Figure 6:
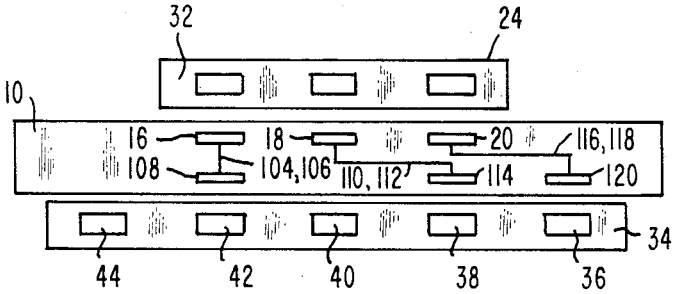

Referring to FIG. 6, contact support member 10 is shown schematically in second operative state. As will be seen, cable 24 is again laterally centered with respect to support member 10, as is cable 34.

The one step transitions are present for the neutral and ground conductors, but support member is now set such that contact element 108 is in registration with conductor 42, the second phase conductor of cable 34. This setting thus provides for interconnection of conductor 26 of cable 24 with conductor 42, and the associated pedestal is powered by the B phase, rather than A phase, as was the case in the FIG. 5 setting.

Figure 7:
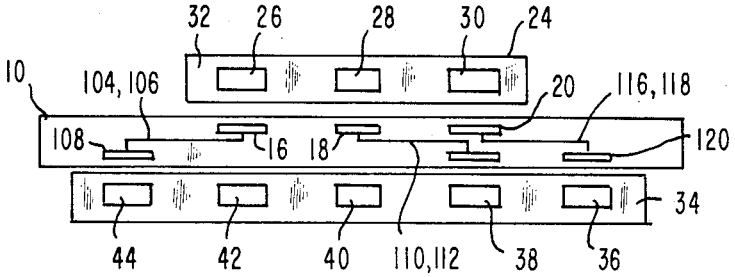

Referring to FIG. 7, contact support member 10 is shown schematically in third operative state. Cable 24 is again laterally centered with respect to support member 10, as is cable 34. The one step transitions are present for the neutral and ground conductors, but support member is now set such that contact element 108 is in registration with conductor 44, the third phase conductor of cable 34. This setting thus provides for interconnection of conductor 26 of cable 24 with conductor 44, and the associated pedestal is powered by the C phase.

By way of summary of the foregoing, it will be seen that the invention broadly provides a flat conductor cable power distribution system comprising a discrete wire multi-phase feeder, a main flat cable having at least four conductors and connected to the feeder allowing plural phase energization and an insulation-piercing power outlet receptacle connected to the main cable and energized with a selective one of such phases. The system may further include a secondary flat conductor cable connected to the main cable at the power outlet receptacle and energized by such one phase. The system is typically multiphase wherein the foregoing practice is repeated for each phase.

In another aspect, a flat conductor cable power distribution system is shown comprising a discrete wire three-phase feeder, a main flat cable having five conductors and connected to the feeder to have energization in first, second and third phases and first, second and third insulation-piercing power outlet receptacles connected to said main cable at different locations thereon and energized respectively by the first, second and third phases. Further shown is a flat conductor cable power distribution system disposed upon a substrate and covered by an overcover, the system including a main cable energized in plural phases, a plurality of secondary cables connected to the main cable and power outlet receptacles connected to the main cable and the secondary cables, each such connection of the main and secondary cables being discernible by structure of the receptacles disposed visibly upon the overcover.

Various changes to the illustrated embodiment of the invention may be introduced without departing from the invention. Thus, the particularly discussed and described preferred embodiment is intended in an illustrative and not in a limiting sense. The true spirit and scope of the invention are set forth in the following claims.

I claim:

1. A flat conductor cable power distribution system comprising a discrete wire multi-phase feeder, a main flat cable having at least four conductors and connected to said feeder to have plural phase energization, an insulation-piercing power outlet receptacle overlying and connected to said main cable and thereby energized with a selective one of such phases, and a secondary flat conductor cable having at least one conductor less than the number of conductors of said main cable connected to said main cable and said power outlet receptacle at the juncture thereof, said secondary cable underlying said power receptacle and being energized by said one phase.

2. The invention claimed in claim 1 wherein said secondary cable is folded upon itself to branch directionally from said main cable.

3. The invention claimed in claim 2 further including a further insulation-piercing power outlet receptacle connected to said secondary cable and energized by said one phase.

4. The invention according to claim 1, wherein said main cable comprises five conductors and said secondary cable comprises three conductors.

5. A flat conductor cable power distribution system comprising a discrete wire three-phase feeder, a main flat cable having five conductors and connected to said feeder to have energization in first, second and third phases, first, second and third insulation-piercing power outlet receptacles overlying and connected to said main cable at different locations thereon and thereby energized respectively by said first, said second and said third phases, and first, second and third secondary flat conductor cables each having four or less conductors, said cables being connected to said main cable respectively at the juncture of said main cable with said first, second and third power outlet receptacles and underlying said first, second and third power outlet receptacles, respectively and being energized respectively by said first, said second and said third phases.

6. The invention claimed in claim 5 wherein each of said first, second and third secondary cables is folded upon itself to branch directionally from said main cable.

7. The invention claimed in claim 6 further including a further insulation-piercing power outlet receptacles connected to said first, second and third secondary cables and energized respectively by said first, said second and said third phases.

8. A method for providing electrical power from a three-phase feeder line throughout an installation in respective different single-phase power outlets, said method comprising the steps of:

(a) laying a five-conductor flat cable on a floor adjacent said feeder and electrically interconnecting conductors of said five-conductor cable individually with electrical neutral, electrical ground and the individual live phases A, B and C of said feeder;

(b) selecting first and second power outlet locations in registry with the run of said five-conductor cable;

(c) disposing a segment of three-conductor cable in overlapped registry with said five-conductor cable at such first selected location;

(d) disposing an electrical power outlet so as to overlie the location of such overlapped registry of said five-conductor and three-conductor cables and electrically interconnecting the neutral, the ground and the A phase conductors of said five conductor cable with the neutral, the ground and the live phase conductor of said three-conductor cable and interconnecting said power outlet with the conductors of said three-conductor cable;

(e) disposing a segment of a second three-conductor cable in overlapped registry with said five-conductor cable at such second selected location;

(f) disposing an electrical power outlet so as to overlie such second location of such overlapped registry of said five-conductor and said second three-conductor cable and electrically interconnecting the neutral, the ground and the B phase conductors of said five-conductor cable with the neutral, the ground and the live phase conductor of said second three-conductor cable and interconnecting said power outlet with the conductors of said second three-conductor cable.

9. The method claimed in claim 8 including the further step of selecting a third power outlet location sideward of the run of said five-conductor cable, folding the first of said three-conductor cables to cause the run thereof to extend to said third location, and disposing an electrical power outlet at such third location and interconnecting said power outlet with the conductors of such first three-conductor cable.

10. The method claimed in claim 8 wherein said neutral, ground and the individual live phase conductor of at least one of said two three-conductor cables is selectively aligned for connection with the neutral, ground and one of the live phase conductors of said five-conductor cable.

11. A method for providing electrical power in an undercarpet wiring system, comprising:

laying a main flat cable having an electrical neutral conductor, an electrical ground conductor and at least two live conductors on a building floor;

disposing a secondary flat cable having an electrical neutral conductor, an electrical ground and at least one live conductor in overlapped relation on said main cable, said overlapping cable portions defining a junction thereat; and disposing at said junction an electrical power outlet so as to overlie the secondary cable and electrically interconnecting thereat the neutral and the ground conductor of the secondary cable with the neutral and ground conductor of the main cable and one live conductor of the secondary cable with a selected one of the live conductors of the main cable and electrically interconnecting the power outlet with the conductors of the secondary cable.

12. A method according to claim 11, further including the step of interposing an adapter between said main cable and said secondary cable to effect electrical interconnection of said conductors of said main and secondary cables.

13. A method according to claim 12, wherein said adapter comprises movable contacts wherein said one live conductor of said secondary cable may be interconnected to either one of said at least two live conductors of said main cable by selectively moving said contacts.

* * * * *